United States Patent [19]

Moran

[11] Patent Number: 5,007,663

[45] Date of Patent: Apr. 16, 1991

[54] APPARATUS FOR PRODUCING ADDRESS LABELS

[76] Inventor: John Moran, P.O. Box 10458, Marina Del Rey, Calif. 90295

[21] Appl. No.: 393,968

[22] Filed: Aug. 14, 1989

[51] Int. Cl.[5] ..... B42D 15/00

[52] U.S. Cl. ..... 283/81; 283/99; 283/100; 283/101

[58] Field of Search ..... 283/81, 101, 99, 100, 283/105, 106, 108, 109; 428/40, 57

[56] References Cited

U.S. PATENT DOCUMENTS

| | | | |
|---|---|---|---|
| 2,109,583 | 2/1936 | Bennett | 428/40 |
| 3,107,195 | 10/1963 | Stegler et al. | 428/57 |
| 3,925,584 | 12/1975 | Suzuki et al. | 428/40 |
| 4,029,341 | 6/1977 | Neill et al. | 283/81 |
| 4,379,573 | 4/1983 | Lomeli et al. | 283/81 |

*Primary Examiner*—Paul A. Bell
*Assistant Examiner*—Tom Hamill, Jr.

[57] ABSTRACT

A multiple ply label assembly intended to be removably adhered to the surface of a sheet (e.g. a sheet of paper stationery) to be printed upon. A printer apparatus (e.g. computer printer or typewriter) is then controlled to concurrently print onto both the sheet surface and label assembly in the same operation. The removably adhered label assembly can then be removed from the sheet without leaving any discernible residue thereon and a label portion of the label assembly can be separated therefrom and affixed to an end use sheet (e.g. an envelope for mailing).

3 Claims, 2 Drawing Sheets

APPARATUS FOR PRODUCING ADDRESS LABELS

FIELD OF THE INVENTION

This invention relates to a multiple ply label assembly particularly suited for producing an address label in the course of printing (e.g. via a typewriter or computer driven printer) a document, e.g. a business letter.

BACKGROUND OF THE INVENTION

It is common practice nowadays for business letters to be printed by computer driven printers. Nevertheless, because of various envelope handling difficulties, office secretaries frequently still use typewriters to separately print addresses on envelopes.

The present invention is intended to eliminate the need to use a second printer apparatus (i.e. typewriter) to separately address envelopes. More particularly, the present invention is directed to a method and apparatus which enables an address label to be printed by a single printer apparatus in the same operation that prints a related document sheet, e.g. business letter, and which enables the address label to be removed from the document sheet, without leaving any discernible residue thereon, for transfer to an envelope for mailing.

Many prior patents are concerned with various aspects of creating labels and applying and removing them from sheet material. However, none appears to suggest the apparatus and method of the present invention for producing an address label in the course of printing a different but related document which can then be readily separated from the document, for transfer to a mailing envelope. The following U.S Pat. Nos. are considered exemplary of the prior art:

3,822,492
4,029,341
4,379,573
4,664,416.

SUMMARY OF THE INVENTION

The present invention is directed to a multiple ply label assembly intended to be removably adhered to the surface of a sheet (e.g. a sheet of paper stationery) to be printed upon. A printer apparatus (e.g. computer printer or typewriter) is then controlled to concurrently print onto both the sheet surface and label assembly in the same operation. The removably adhered label assembly can then be removed from the sheet without leaving any discernible residue thereon and a label portion of the label assembly can be separated therefrom and affixed to an end use sheet (e.g. envelope for mailing).

A preferred label assembly in accordance with the invention is comprised of a base ply of thin, inexpensive, flexible material, such as paper, having upper and lower principal surfaces. The lower surface is coated with a low tack adhesive for removably adhering the base ply to the surface of a sheet to be printed upon. The upper surface of the base ply is coated with a suitable release material. The label assembly further includes an address label of thin, inexpensive, flexible material which can be clear or opaque. The address label has an upper surface which may bear some preprinted material and a lower surface which is coated with a high tack adhesive. When integrated in the label assembly, the address label lower surface contacts the base ply upper surface. The release material enables the address label to be peeled from the base ply for transfer to an end use sheet (e.g. envelope) so that the high tack adhesive can substantially permanently secure the address label thereto.

Although the primary application of a label assembly in accordance with the invention is to produce address labels for fixing to mailing envelopes, it is recognized that the invention may have significant other applications. Thus, the term "address" label should be broadly understood to refer to any separable label intended to be substantially permanently affixed to an end use sheet such as a mailing envelope.

DETAILED DESCRIPTION OF PREFERRED EMBODIMENT

Figure 1:
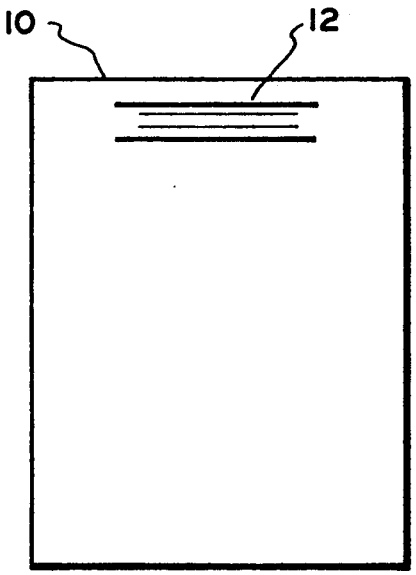
FIG. 1 is a top view of a typical paper sheet of stationery to be printed upon.
Figure 3:
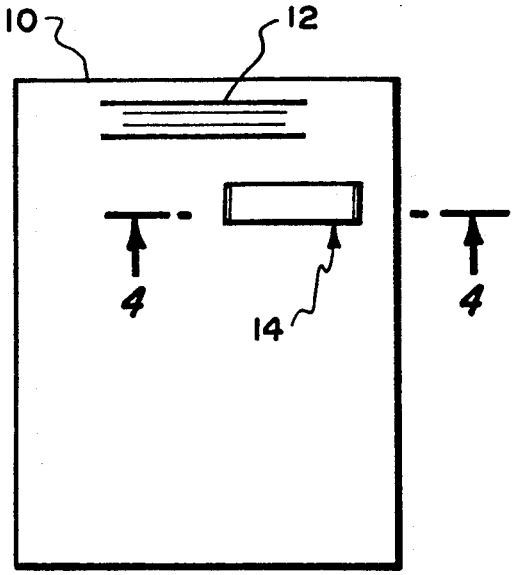
FIG. 3 is a top view showing the label assembly of FIG. 2 mounted on the paper sheet of FIG. 1, prior to printing.
Figure 2:
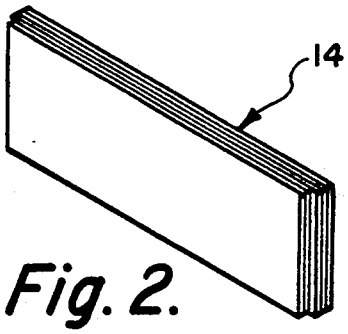
FIG. 2 is an isometric view of a multiple ply label assembly in accordance with the present invention.

FIG. 1 depicts a sheet of material (e.g. paper) 10 upon which images (e.g. alphanumeric and/or graphic) are to be printed. The sheet 10 can be totally blank or, as in a more typical application, can include some preprinted material 12, e.g. a form or letterhead which identifies the creator of the document to be printed, e.g. a firm name and address. In a typical office situation, a secretary will print a business letter on the sheet 10 and will include the address of the intended recipient. The secretary will also usually separately prepare, i.e. address, a mailing envelope. The present invention is directed to a method and apparatus whereby a multiple ply label assembly 14 can be affixed to a selected area of the paper sheet 10, as shown in FIG. 3, prior to printing so that in a single printing operation, both document material can be printed onto the sheet 10 and address material can be printed onto the label assembly 14. Note in FIG. 3 that the label assembly 14 is positioned on the upper right hand portion of the sheet which area is typically selected because it is usually left blank in most business correspondence formats. Thus it is available for the temporary placement of the label assembly 14.

Prior to discussing the structure of the multiple ply label assembly 14, it will be helpful to define certain terms as applied to surface bonding. These terms will be used hereinafter to explain the relationship between a first surface and a second surface.

The word "removable" will be used to refer to a type of surface bond which permits a first surface to be readily peeled from a second surface without leaving any discernible residue on the second surface. The type of adhesive used to form such a removable bond will be referred to as a low tack adhesive. Such adhesives are readily known in the art. For example only, Post-it brand self stick removable notes marketed by Minnesota Mining and Manufacturing Company use such a low tack adhesive.

The term "nonremovable" will be used to refer to a type of surface bond which prevents a first surface from being peeled from a second surface without either damaging one of the surfaces or at the least leaving discernible residue on the second surface. The type of adhesive used to form such a permanent bond will be referred to as a high tack adhesive. Pressure sensitive high tack adhesives of varying bonding strength are well known in the art.

The term "releasable" will be used to refer to a type of surface bond which permits a first surface, which may be coated with high tack adhesive, to be readily peeled from a specially coated release surface of a second surface. Release coatings are well known in the art and are frequently used to permit pressure sensitive labels to be peeled from a base carrier sheet.

Figure 4:
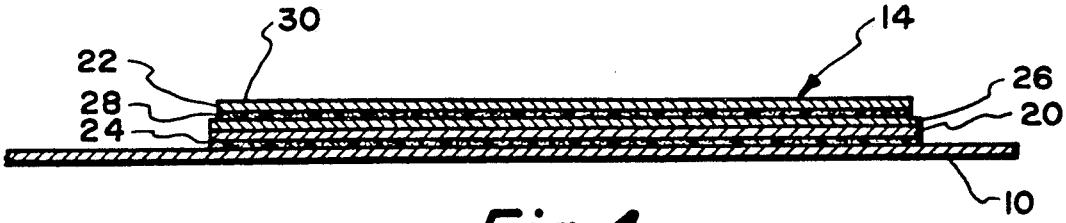
FIG. 4 is a sectional view taken substantially along plane 4—4 of FIG. 3.

Attention is now directed to FIG. 4 which shows the multiple ply label assembly 14 temporarily mounted on the sheet 10. The multiple ply label assembly includes a base ply 20 and a label ply 22 each having upper and lower surfaces.

The base ply lower surface, in accordance with the invention, is coated with a low tack adhesive layer 24 enabling the label assembly to be removably bonded to the upper surface of sheet 10. The upper surface of base ply 20 is coated with a release material 26 for forming a releasable bond with the lower surface 28 of label ply 22. Label ply lower surface 28 has a high tack adhesive layer applied thereto. Label ply upper surface 30 can bear preprinted alphanumeric and/or graphic material.

Figure 5:
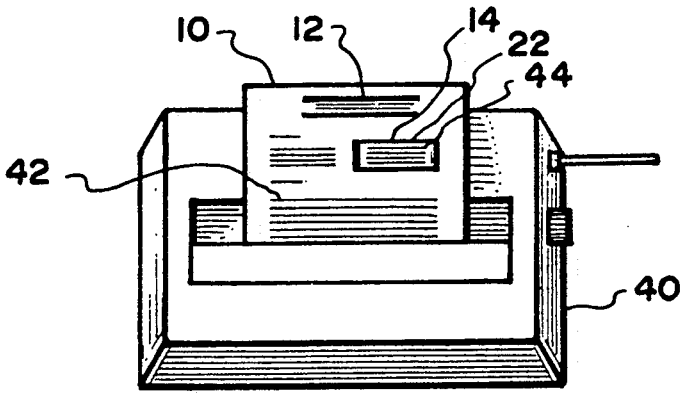
FIG. 5 is an isometric view showing the sheet/label assembly combination being processed in a printer apparatus to concurrently print on both the sheet and label assembly.

After the label assembly 14 has been positioned on and removably bonded to the sheet 10, it can be processed in a printer apparatus 40 (FIG. 5) during which document material 42 and address material 44 can be respectively printed on the upper surfaces of sheet 10 and label ply 22 in the same operation. It should be understood that the printer apparatus 40 can comprise a manually driven printer such as a typewriter, but more typically will comprise a computer driven impact or non impact printer. The sheet 10 can comprise a single sheet or a panel of an elongated web of computer type fan folded paper of either single or multi-part form. Regardless of the paper format, or indeed whether it is actually paper or some other material, the significant aspect of the invention is that the multiple ply label assembly 14 can be temporarily positioned on and removably adhered to the sheet 10 prior to it being processed by the printer 40. Consequently, the printer is able to print on the label ply 22 concurrent with its printing document material on the sheet 10.

Figure 6:
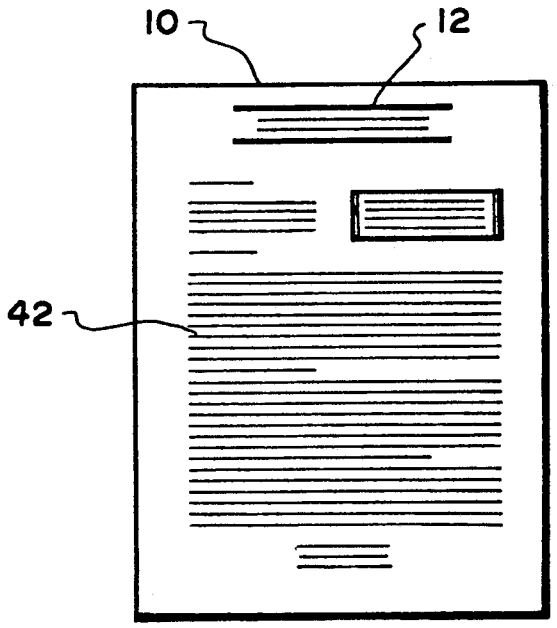
FIG. 6 is a top elevation view of the paper sheet after removal of the label assembly.
Figure 7:
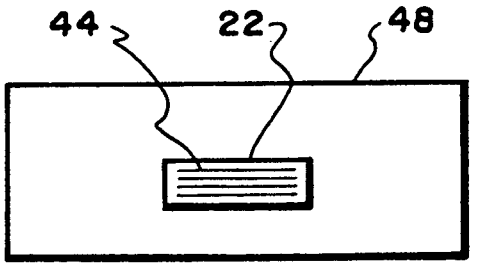
FIG. 7 is a top view showing the label portion of the label assembly affixed to a mailing envelope.

After printing, the base ply can first be peeled from the sheet 10 with its low tack adhesive leaving no discernible residue on the sheet. Then, the label 22 can be released from the base ply 20 by peeling it away from release layer 26. The label 22, still bearing a high tack adhesive on its lower surface 28 can then be affixed to an end use sheet surface, for example a mailing envelope 48 (FIG. 7). The sheet 10 bearing printed document material thereon, as shown in FIG. 6, is ready for placement in the mailing envelope 48.

From the foregoing, it should be recognized that a method and label assembly have been disclosed herein which enables an address label to be printed by a single printer apparatus in the same operation used to print a related document. Although a preferred embodiment has been disclosed herein, it is recognized that various modifications will readily occur to those skilled in the art falling within the scope of the appended claims. For example only, a multiple ply label containing carbon or carbonless copying means could be substituted for the single ply label 22 depicted in FIG. 4.

I claim:

1. A multiple ply label assembly suitable for producing a separate label in the course of printing a document sheet, said label assembly comprising a base ply having upper and lower surfaces;

said base ply lower surface having low tack adhesive means applied thereto for removably bonding said base ply to the surface of the document sheet so that said base ply can be readily peeled from the sheet without damaging or leaving discernible residue on the sheet;

said base ply upper surface having a layer of release material applied thereto;

a label ply having upper and lower surfaces;

said label ply lower surface having high tack adhesive means applied thereto suitable for nonremovably bonding said label ply to a surface of an end use sheet so that said label ply cannot readily be peeled from the end use sheet without damaging or leaving discernible residue on the sheet;

said label ply being superimposed on said base ply with said label ply adhesive means contacting said layer of release material to enable said label ply to be readily peeled from said base ply and be nonremovably bonded to the end use sheet surface.

2. A label assembly comprised of a base ply and a label ply adapted to be (1) temporarily adhered to the surface of a document sheet so that a surface of said label ply can be printed concurrently with the printing of the document sheet surface; (2) removed from the document sheet surface without damaging or leaving discernible residue thereon; and (3) separated for enabling said label ply to be permanently adhered to an end use sheet, said label assembly comprising:

a label ply having upper and lower surfaces;

a base ply having upper and lower surfaces;

said label ply lower surface bearing a coating of high tack adhesive means;

said base ply upper surface bearing a coating of release means for releasably bonding to said high tack adhesive means;

said label ply being superimposed on said base ply with said label ply adhesive means contacting said base ply release means whereby said plies are releasably bonded together; and said base ply lower surface bearing a coating of low tack adhesive means for removably bonding said base ply to the surface of a document sheet to enable concurrent printing on both the document sheet surface and the upper surface of said label ply.

3. A two ply label assembly useful for producing an address label having address information on an upper surface thereof and adhesive means on a lower surface thereof for permanently bonding the label to the surface of an envelope, said label assembly comprising:

a base ply having upper and lower surfaces;

said base ply lower surface being coated with low tack adhesive means for temporarily bonding said base ply directly to the surface of a document sheet to be printed upon, said low tack adhesive means enabling said base ply to be readily peeled from the document sheet without damaging or leaving discernible residue on the sheet;

said base ply upper surface being coated with release material;

a label ply having upper and lower surfaces;

said label ply lower surface being coated with high tack adhesive means, said label ply being superimposed on said base ply with said label ply lower surface adhesive means contacting said base ply upper surface release material whereby said plies are releasably bonded together and said label ply upper surface is oriented to be printed upon when said base ply is bonded to the document sheet, said releasable bonding between said high tack adhesive means and said release material permitting said label ply to be readily peeled from said base ply for use as said address label.

* * * * *